US012135183B2

(12) United States Patent
Schumacher et al.

(10) Patent No.: US 12,135,183 B2
(45) Date of Patent: Nov. 5, 2024

(54) FOLLOWER FOR A CARTRIDGE MAGAZINE

(71) Applicant: Schmeisser GmbH, Krefeld (DE)

(72) Inventors: Andreas Schumacher, Krefeld (DE); Thomas Hoff, Krefeld (DE); Tim Schnellen, Krefeld (DE)

(73) Assignee: Schmeisser GmbH, Krefeld (DE)

( * ) Notice: Subject to any disclaimer, the term of this patent is extended or adjusted under 35 U.S.C. 154(b) by 103 days.

(21) Appl. No.: 17/869,545

(22) Filed: Jul. 20, 2022

(65) Prior Publication Data

US 2022/0357120 A1 Nov. 10, 2022

Related U.S. Application Data

(63) Continuation of application No. PCT/EP2021/000004, filed on Jan. 18, 2021.

(30) Foreign Application Priority Data

Jan. 20, 2020 (DE) ..... 10 2020 000 298.6

(51) Int. Cl.
*F41A 9/70* (2006.01)
*F41A 17/36* (2006.01)

(52) U.S. Cl.
CPC ..... *F41A 9/70* (2013.01); *F41A 17/36* (2013.01)

(58) Field of Classification Search
CPC ..... F41A 9/65; F41A 9/69; F41A 9/70; F41A 9/71; F41A 9/36
USPC ..... 42/50
See application file for complete search history.

(56) References Cited

U.S. PATENT DOCUMENTS

| | | | | |
|---|---|---|---|---|
| 8,739,446 | B2 * | 6/2014 | Sullivan | F41A 9/69 42/50 |
| 2010/0126053 | A1 * | 5/2010 | Fitzpatrick | F41A 9/69 42/50 |
| 2011/0173857 | A1 * | 7/2011 | Hogan, Jr. | F41A 9/68 42/50 |
| 2012/0131831 | A1 * | 5/2012 | Sullivan | F41A 9/65 42/50 |

(Continued)

FOREIGN PATENT DOCUMENTS

| | | | |
|---|---|---|---|
| DE | 10 2018 000 740 A1 | 8/2019 | |
| WO | WO-2012003020 A2 * | 1/2012 | F41A 9/61 |

OTHER PUBLICATIONS

International Search Report dated May 19, 2021 for International Application No. PCT/EP2021/000004 (4 pages).

*Primary Examiner* — John Cooper
(74) *Attorney, Agent, or Firm* — Taylor IP, P.C.

(57) ABSTRACT

A feeder for a cartridge magazine for a portable firearm includes: a first cartridge supporting surface at an upper region; a second cartridge supporting surface, the first cartridge supporting surface and the second cartridge supporting surface being arranged in a third spatial direction spaced at a distance from one another in such a way that a cartridge for the portable firearm is movable along the feeder in a direction of a front region; a front guide part including a front support surface; and a rear guide part including a rear support surface, a rigid part, and a movable part, the rear support surface including a first support surface and a second support surface, the first support surface being on the rigid part, the second support surface being on the movable part.

25 Claims, 6 Drawing Sheets

(56) References Cited

U.S. PATENT DOCUMENTS

| | | | | |
|---|---|---|---|---|
| 2015/0075049 | A1* | 3/2015 | Klarborg | F41A 9/70<br>42/49.01 |
| 2015/0121736 | A1* | 5/2015 | Faifer | F16F 1/021<br>42/49.01 |
| 2016/0076841 | A1* | 3/2016 | Ballard | F41A 9/65<br>42/50 |
| 2016/0348992 | A1* | 12/2016 | Tisone | F41A 9/70 |

* cited by examiner

FOLLOWER FOR A CARTRIDGE MAGAZINE

CROSS REFERENCE TO RELATED APPLICATIONS

This is a continuation of PCT Application No. PCT/EP2021/000004, entitled "FEED DEVICE FOR A CARTRIDGE MAGAZINE FOR A HANDGUN, FEED DEVICE UNIT FOR A CARTRIDGE MAGAZINE FOR A HANDGUN, CARTRIDGE MAGAZINE FOR A HANDGUN, AND METHOD FOR OPERATING A HANDGUN", filed Jan. 18, 2021, which is incorporated herein by reference. PCT Application No. PCT/EP2021/000004 claims priority to German Patent Application No. DE 10 2020 000 298.6, filed Jan. 20, 2020, which is incorporated herein by reference.

BACKGROUND OF THE INVENTION

1. Field of the Invention

The present invention relates to a feeder for a cartridge magazine for a portable firearm, wherein the feeder extends along a first spatial direction, a second spatial direction and a third spatial direction, thereby forming an upper region, a lower region, a rear and a front region, wherein the feeder at its upper region has a first cartridge supporting surface and a second cartridge supporting surface which are arranged in a third spatial direction spaced apart from one another in such a way, that a cartridge for a portable firearm is movable along it in the direction of the front region, wherein the feeder moreover has a front guide part which forms at least one front supporting surface and a rear guide part which forms at least one rear support surface.

The present invention further relates to a feeder unit with an outer feeder, an inner feeder and a compression spring, wherein the compression spring is arranged between the outer feeder and the inner feeder, and wherein the outer feeder has a space into which the inner feeder is movable against a spring force of the compression spring.

The present invention further relates to a cartridge magazine for a portable firearm, wherein the cartridge magazine has: a housing for a cartridge magazine for a portable firearm, which extends along a first spatial direction, a second spatial direction and a third spatial direction and which—in its interior—has an interior space with at least one first region, wherein the interior space is limited by the inside surfaces of a front wall, a rear wall, a first side wall and a second side wall; and wherein the inside surfaces of the front wall and the rear wall in this at least one region have a distance to each other; and wherein the housing has a bottom side and a top side, wherein magazine lips are formed on the top side of the housing; and wherein the bottom side of the housing is designed to be at least partially open, wherein the cartridge magazine further includes a bottom cover which is suitable to at least substantially close the at least partially open bottom side of the housing, and includes at least one first feeder which is arranged in the interior of the cartridge magazine against a spring force of a main spring in the direction of the bottom side of the housing and in particular arranged movably in the direction of the floor cover, wherein the feeder extends along a first spatial direction, a second spatial direction and a third spatial direction and thereby forms an upper region, a lower region, a rear region and a front region; wherein the feeder at its upper region has a first cartridge supporting surface and a second cartridge supporting surface, which are arranged in the third spatial direction at a distance from one another other, and which are designed respectively in such a way that a cartridge for a portable firearm can be moved from a storage position along it in the direction of the front region to a removal position, wherein the feeder moreover has a front guide part which forms at least one front support surface and a rear guide part which forms at least one rear support surface.

The present invention ultimately relates to a method for operating a portable firearm.

2. Description of the Related Art

Cartridge magazines for portable firearms have been known for a long time and are manufactured according to the state of the art in different designs. The expert distinguishes hereby between cartridge magazines firmly connected to the portable firearm and those that can be quickly and repeatedly connected to the portable firearm by releasing a holding mechanism. Among the latter cartridge magazines, which are then also referred to as cartridge plug-in magazines, drum magazines and stack-type magazines are most commonly known. The cartridge magazine in its various embodiments, which is the basis of the current invention, relates in particular to such a stack-type magazine. In a stack-type magazine the cartridges are stored in such a manner that, at least in a partially filled cartridge magazine, they touch each other tangentially at their casing walls inside the housing of the cartridge magazine. Depending on whether the stack-type magazine is single-row or multi-row, the contact points or contact lines of the cartridges shift among each other.

The behavior of the cartridges in relation to one another differs significantly between cartridge plug-in magazines designed as stack-type magazines, the front and rear walls of which are formed at least in sections along a curved path, in particular a circular path, for example with a radius of between 600 mm and 1800 mm, and those whose front and rear walls are formed by two straight components aligned parallel to one another. The terms curved path or circular path, as well as the term straight line and other descriptive terms are to be interpreted in the technical sense in the context of the description of the invention. It is clear to the expert that a straight wall is subject to certain manufacturing tolerances or that a force to be measured does not have to correspond absolutely exactly to the values stated here.

In particular for use by authorities, but also for sporting applications—and herein, mainly in so-called dynamic disciplines—it is often desirable to equip a portable firearm with a suitable cartridge magazine that provides high fire power. This is understood to be the ability to fire a high number of shots within a short time.

Since the exchange of a cartridge magazine—depending on the design of the retaining mechanism and the skill of the operator—requires a certain time, for example 2 to 4 seconds, the endeavor is to make the holding capacity of an individual cartridge magazine as large as possible.

In contrast thereto however is the manageability of the cartridge magazine for the operator who needs to carry the cartridge magazine also apart from the portable firearm—as a spare magazine—which must be co-designed manageable for the operator even in stress situations and which does not reduce the manageability of the portable firearm with inserted cartridge magazine, or at least reduces it to the least possible degree.

A cartridge magazine which fulfills the desire for high capacity and at the same time good handling has become known from DE 10 2018 000 740 A1. This cartridge magazine is already used very successfully in weapon models used by authorities.

Such a weapon model is, for example, the self-loading rifle according to type AR-15/AR-16, which has been in use by authorities worldwide for several decades. For a repeatable, detachable connection of cartridge plug-in magazines with the portable firearm, this weapon has a downwardly open magazine shaft in which suitable cartridge magazines can be inserted. For this purpose, cartridge magazines with different capacities are known. For the operation of a self-loading rifle, for example according to the aforementioned model, or another, generic portable firearm, magazines holding 10, 20 or 30 cartridges are still generally used today. A portable firearm of the same type is understood to be a self-loading rifle that offers the operator a choice between a first mode in which the weapon can be operated in such a way that a single shot is always triggered by the one-time operation of its trigger and a second mode in which the weapon can be operated in such a way that a plurality of shots is always triggered by the one-time operation of its trigger. In connection with the present description, the generic similarity of the described portable firearm should also be preserved if the operator can additionally choose between the delivery of a closed group of shots, for example 3- or 5-shot bursts of fire or a continuous fire when selecting a plurality of shots to be fired. Likewise, in connection with the present description, the genericity of the described portable firearm should also be preserved if the operator can operate the weapon only in the first mode in a variation of the corresponding model intended for the civilian market, but the weapon otherwise—at least substantially—corresponds to the corresponding model. In connection with the present description, adjustments that have no direct influence on the self-loading function of the weapon are considered not essential. Examples of a generically same portable firearm within the scope of the present document are, for example, self-loading rifles according to model AK-47, AK 74, HK G 3, HK G36, FN MK 16 or MK 17, SIG 550, Steyr AUG and many others.

In addition to the possibility of designing a cartridge magazine built according to the teaching of DE 10 2018 000 740 A1 for high shooting capacities of, for example, 50 shots, 60 shots, 80 shots or even 100 shots, and the associated increase in operational effectiveness, the excellent reliability of the function of these magazines is a decisive reason for the rapid acceptance in the market. Partly responsible for this is an influence on the roll-off points of the cartridge casing surfaces with each other. The cartridges will move upwards in high-frequency jumps, for example during the operation of the portable firearm in a fully automatic operating mode and are also exposed to longitudinal forces with alternating signs due to their own mass inertia forces, while the center of gravity of the cartridge magazine and thus also the portable firearm in operation will also move.

During this process, the cartridges in the aforementioned cartridge magazine are stabilized by two protrusions protruding into the interior space, which are matched in a certain ratio relative to the magazine interior geometry (and the geometry of the cartridges).

For this purpose it is however necessary, that the feeder of such a cartridge magazine—for example in its center region or its rear end region—must create a free space, designed depending on the corresponding protrusion.

However, provision of a free space at this location of the feeder can in certain weapon models—for example in the aforementioned self-loading rifles according to type AR-15/AR-16—result in that the breech mechanism of the self-loading rifle is not caught in the open state, as desired after delivery of the last shot.

According to the teachings of DE 10 2018 000 740, a locking device can be provided for this purpose, partially externally, arranged on the magazine housing and movable in the height direction. Although the aforementioned locking device is able to reliably catch the breech or to release the slide catch lever provided for this purpose on the side of the weapon, it is however possible that disadvantages could arise during cleaning after particularly tough use.

Irrespective of this, the invention is also based on the observation that many plug-in cartridge magazines available in the market with 10, 20 or 30 shot capacities are not suitable for catching the breech mechanisms, in particular of self-loading rifles specially manufactured for sporting purposes according to the said type, but also according to other models, or to release the slide catch lever provided for this purpose on the side of the weapon.

What is needed in the art is to overcome at least a part of the mentioned disadvantages of the prior art.

SUMMARY OF THE INVENTION

The present invention provides a feeder for a cartridge magazine for a portable firearm, wherein the feeder extends along a first spatial direction, a second spatial direction and a third spatial direction, thereby forming an upper region, a lower region, a rear and a front region, wherein the feeder at its upper region has a first cartridge supporting surface and a second cartridge supporting surface which are arranged in a third spatial direction spaced apart from one another in such a way, that a cartridge for a portable firearm is movable along it in the direction of the front region, wherein the feeder moreover has a front guide part which forms at least one front supporting surface and a rear guide part which forms at least one rear support surface, wherein the rear support surface is formed by at least a first support surface and a second support surface and that the first support surface is designed on a rigid part and the second support surface on a movable part of the rear guide part.

As a result of the rear support surface being formed by at least a first support surface and a second support surface and the first support surface being formed on a rigid part and the second support surface on a movable part of the rear guide part, it is possible that on the one hand (in at least one position), by way of the rigid part and the movable part of the rear guide part together, the function of the formation of a sufficiently large and in particular safe functioning sufficiently geometrically distributed support surface can be fulfilled, while each part on its own, in other words, both the rigid part, as well as the movable part of the rear guide part, (in at least one position) is suitable for the fulfillment of a further function. Thus, the rigid part may additionally provide the function of a fixed abutment and/or a travel limiter and/or a guide and/or an insertion aid, while for example, the function of a trigger may be additionally provided by the movable part. Within the scope of this document, the terms "movable" and "rigid" are to be interpreted in the technical-practical sense. A part is to be understood as being "movable" if it can be moved in a normal individual case of use from its intended, technical environment in at least one intended position, or if it moves in this environment, for example, due to a residual stress in at least one intended position of its own accord. On the other hand, a part is to be understood as "rigid" if it cannot be moved from its intended, technical environment in a normal case of use in any intended position to a functionally relevant extent and does not move accordingly in this environment from residual tension.

In connection with the present document, the term "support surface" is to be understood in particular as a surface that is suitable for supporting the feeder on a suitable surface or an appropriate area of a cartridge magazine, in particular a surface or an area of an inside wall of the cartridge magazine, or its housing. The overall acting support surface can be divided or at least formed by a first support surface and a second support surface.

It is optional that the movable part forming the second support surface is designed as a movable leg, which is deflected unilaterally on the feeder, or on a connection area of the feeder or from this area forms a continuation of the feeder whose longitudinal direction extends in the third spatial direction, wherein the free leg part in the third spatial direction optionally extends above the connection area. Then the leg can also form a "quasi-rigid" third support surface at its joint point, in other words, in the connection region.

It may be advantageous if the movable part forming the second support surface can be moved from a first position at least along the first spatial direction into a second position.

The term "position" of the movable part is understood exclusively in relation to the rest of the body of the feeder or at least a part thereof, in particular in relation to the rigid part. This applies to the first position, but also to other positions mentioned or implicitly disclosed in this document, in particular to the second position and to the third position.

This has the advantage that it is possible for the movable part to enter and exit into the assembly space otherwise described by the feeder. In particular, an extension and/or a shortening of the expansion of the feeder along the first spatial direction is made possible, optionally in a repeatable manner.

As an alternative it can also be advantageous, if the movable part representing the second support surface is movable from at least a first position along the second spatial direction into a second position.

This provides the advantage that entering and exiting of the movable part in the assembly space otherwise described by the feeder is made possible. In particular, an extension and/or shortening of the expansion of the feeder along the second spatial direction is made possible, optionally in a repeatable manner.

Alternatively to the two aforementioned design variations, it may be optional that the movable part representing the second support surface can be moved from a first position at least along the third spatial direction into a second position.

This provides the advantage that entering and exiting of the movable part in the assembly space otherwise described by the feeder is made possible. In particular, an extension and/or shortening of the expansion of the feeder along the second spatial direction is made possible, optionally in a repeatable manner.

It is optional that the movable part representing the second support surface is movable from the second position along the first spatial direction into a third position.

Since the first spatial direction corresponds to the longitudinal direction of the feeder and thus, when the feeder is arranged or used in a cartridge magazine inserted in a portable firearm, is also positioned in the firing direction of the portable firearm and the movability can thus be influenced to a particular degree by the effect of recoil forces, such a design offers the advantage of assigning various functions to the movable part without having to run the risk of reducing the functional safety. The second position can be designed in particular as an "intermediate" position between the first and the second position.

Alternatively to the aforementioned design characteristic it may also be optional, that the movable part representing the second support surface is movable from the second position at least along the second spatial direction into a third position.

Such an arrangement can be optional, if the movable part representing the second support surface is movable from the first position at least along the first or third spatial direction into the second position. The provision of movability along the second spatial direction in connection with the operation of a portable firearm is subject to an especially low risk of failure, since recoil forces occurring during operation are essentially formed along the first spatial direction (with positive and negative signs), but generally also form proportionately along the third spatial direction (with positive and negative signs).

At first glance, it may seem absurd to assign this degree of freedom to the mobility from and in the direction of the second position ("intermediate position") arranged between the first position and the third position. However, in this way it becomes possible to assign an operating function to this position, or to design the second position as an operating position.

It is optional that the support surface and/or a surface of the movable part of the feeder arranged angularly to it is arranged in the second position on both sides of the centerline of the feeder progressing in the first spatial direction.

As a result, for example, a sliding catch lever can be released safely and reliably on many weapon models, for example in self-loading rifles according to the AR-15/AR-16 design model.

Alternatively to the two aforementioned arrangements it may however be optional, that movable part representing the second support surface is movable from the second position at least along the third spatial direction into a third position.

Such an arrangement can be optional, if the movable part representing the second support surface is movable from the first position at least along the first or the third spatial direction into the second position. In each case it is thereby advantageous, that the movement from the second into the third position or vice versa—at least when considering the primary movement component—is orthogonal relative to the movement of the first into the second position, or vice versa.

In each case it is highly advantageous, if the movable part representing the second support surface is movable from the first position into the second position, against a first reset force.

In this way, the first position can be set as an optional position.

In this way, the first position can be defined as an optional position compared to the second position. In addition, a definable position of the movable part is thus determined, since in this case the movable part only moves—against the direction of action of the first reset force—when it is acted upon by an applied force that is greater than the first reset force. Thus, movements due to their own mass inertia force for example, can be excluded up to certain acceleration values.

In addition, a surprising effect has emerged in trials:

If the movable part representing the second support surface can be moved from the first position at least along the first spatial direction into the second position thereby allowing an extension of the expansion of the feeder along the first spatial direction, a friction force between the support surface and (rear) inside sidewall of the cartridge magazine housing results when using the feeder in a cartridge magazine for a portable firearm.

Normally, such frictional forces are to be strictly avoided since they are contrary to the function and often are the cause for malfunctions and unreliability.

However, since the rigid part prevents an excessively large frictional force from being achieved, the frictional force acting on one side can have an advantageous effect on the function of the magazine. The feeder is thus more strongly drawn to the cartridge to be supported with its cartridge support surface opposite the movable part.

In other words, the cartridge positioned there is better guided through the cartridge support surface and the mobility of the cartridges among each other is reduced.

This has a considerable influence on the functional reliability of the cartridge magazine and thus of the portable firearm, especially since here, for example, 20, 30, 60, 80 or 100 cartridges, which are mutually supported on their round casing surfaces and in operation are subjected to high-frequency vibrations, must together circumscribe a circular path during their upward movement in the direction of their longitudinal direction under certain circumstances and must be able to be fed absolutely reliably to the barrel of a portable firearm at a feed rate of up to 1200 cartridges per minute.

It is thus optional that the movable part and the rigid part are arranged adjacent to one another, viewed in second spatial direction, which already results from the requirement to provide a common support surface.

Further, in connection with the fact that the feeder has at its upper region a first cartridge supporting surface and a second cartridge supporting surface which are arranged spaced apart from each other in the third spatial direction, it is optional that the movable part is arranged on the side of the feeder on which the cartridge supporting surface is higher.

It is further optional that the first cartridge supporting surface and the second cartridge supporting surface are connected at least in sections by a cartridge supporting surface. This increases the storage stability.

In connection with the aforementioned effect that the feeder, during its high-frequency abrupt upward movement is brought closer to the lower cartridge supporting the stack of cartridges arranged above it in a cartridge magazine by the frictional force acting on one side, the effect is that this cartridge, which is stored on the lower cartridge support surface, is additionally pressed with slight force against the cartridge support surface connecting the two cartridge support surfaces at least in sections. This reliably results in a particularly safe and repeatable storage of the cartridge stored there and, as a result, of all cartridges in the cartridge magazine ("cartridge stack"), the number of which naturally decreases during operation.

It is also greatly advantageous, if the movable part representing the second support surface is movable from the second position into the third position, against a second reset force.

In this way, the second position can be defined as an optional position compared to the third position. In addition, even if a third position is provided, a definable position of the movable part can always be determined, since in this case the movable part only moves—against the direction of action of the first reset force—when it is acted upon by an applied force that is greater than the second reset force. Thus, for example, movements due to their own mass inertia force can be excluded up to certain acceleration values.

It is particularly advantageous if the movable part representing the second support surface has a first control surface, via which a movement from the first position into the second position can be initiated.

In this way, a defined movement from the first to the second position can be easily and reliably initiated and optionally mechanically controlled.

It is also of particular advantage if the movable part representing the second support surface has a second control surface via which a movement from the second position into the third position can be initiated.

In this way, a defined movement from the second into the third position can be easily and reliably initiated and optionally mechanically controlled.

Furthermore, it is optional that the movable part representing the second support surface in the first position is free of a reset force acting upon it.

This helps to extend the service life of the feeder, thereby being able to guarantee the reliable use in a cartridge magazine for a portable firearm over a longer period of time.

Optionally, the first reset force and/or the second reset force are in a range of between approx. 2.5 N and approx. 30 N, optionally between 4 N and 19 N, optionally between 4.5 N and 12.5 N.

Surprisingly, these values emerged as being advantageous in experiments. It is assumed that these values are already sufficiently large to ensure, on the one hand, secure positioning of the movable part and, optionally, to produce the additional effect of improved tracking of the feeder or improved storage of the cartridge(s) stored on it and, at the same time, not to produce excessive frictional forces which—above a certain force—could possibly reverse the positive effect.

In addition, it is greatly advantageous if the second reset force is greater than the first reset force.

This can significantly increase the functional reliability. In addition, this can also make it possible in particular to counter a functional element, for example one provided on the weapon side, which itself operates under force, in the operating state and to ensure safe interaction. Because of the previously described operating conditions and the also described interrelationships, functional elements whose direction of movement progresses along the second spatial direction are provided in many portable firearm models.

It is moreover advantageous, if the first support surface and the second support surface are arranged in the first position in at least the first spatial direction and in the second position in the second spatial direction at a distance from one another.

As a result, a high support and positive guidance effect is achieved, while the effective support surface can be kept relatively small. In this way, a large friction surface and the associated large fluctuations in friction behavior, for example in the case of contamination, can be avoided. In addition, sufficient space is available to be able to discharge contaminants (actively or passively). For this reason, it is also optional that the first support surface and the second support surface are no longer (or only minimally) spaced apart from each other in the second position in the first spatial direction.

Optionally, the feeder has at least one travel limiter that limits the movability of the movable part of the rear guide part in at least one spatial direction.

On the one hand, this increases the service life of the feeder, and also prevents in particular undesirable overextensions, for example when cleaning the feeder.

Also, the provision of an accordingly designed travel limiter can be useful in this case when installing the feeder in a cartridge magazine.

The feeder is especially advantageously designed as a single-part component.

This significantly increases the stability and thus the service life of the feeder. In addition, the feeder can be produced in a cost-effective manner. In addition, the feeder is thus excluded from the outset from the risk of loss of small parts.

It is also of great advantage if the feeder is constructed to at least 95%, in particular to at least 98%, in particular at least 99.5% of plastic, optionally of polyoxymethylene (POM).

On the one hand, this can save weight and the feeder can be produced cost-effectively. Surprisingly, it has been shown that the feeder can be produced from plastic in spite of the provision of a movable part and can even meet the extremely high reliability requirements particularly well.

Although no polyoxymethylene has been used to date for a feeder and, in particular in the case of a one-piece design, the provision of a movable part could argue against this, this material has surprisingly proved to be particularly effective in tests.

The present invention also provides a feeder unit with an outer feeder, an inner feeder and a compression spring, wherein the compression spring is arranged between the outer feeder and the inner feeder, and wherein the outer feeder has a space into which the inner feeder is movable against a spring force of the compression spring, wherein the feeder unit has as the inner feeder a feeder designed as described above.

The advantages resulting therefrom can be found in the preceding description of the feeder and are not repeated here for economic reasons.

Such a feeder unit, however, further offers the advantage that the cartridges to be carried in a cartridge magazine can be carried in a sufficiently stable manner even if the cartridge magazine has a second region in addition to a first region and a third region arranged between them, and if the number of cartridges that can be stored next to each other in the first region and in the second region differs from each other. For example, such a feeder unit can be designed in such a way that the first (upper, i.e. forming the magazine lips) region is designed in a two-row and the second region in a four-row configuration, wherein then the transition from four-row stacking to two-row stacking is then provided in the intermediate region.

The present invention also provides a cartridge magazine for a portable firearm, wherein the cartridge magazine has: a housing for a cartridge magazine for a portable firearm, which extends along a first spatial direction, a second spatial direction and a third spatial direction and which—in its interior—has an interior space with at least one first region, wherein the interior space is limited by the inside surfaces of a front wall, a rear wall, a first side wall and a second side wall; and wherein the inside surfaces of the front wall and the rear wall in this at least one region have a distance to each other; and wherein the housing has a bottom side and a top side, wherein magazine lips are formed on the top side of the housing; and wherein the bottom side of the housing is designed to be at least partially open, wherein the cartridge magazine further includes a bottom cover which is suitable to at least substantially close the at least partially open bottom side of the housing, and includes at least one first feeder which is arranged in the interior of the cartridge magazine against a spring force of a main spring in the direction of the bottom side of the housing and in particular arranged movably in the direction of the floor cover, wherein the feeder extends along a first spatial direction, a second spatial direction and a third spatial direction and thereby forms an upper region, a lower region, a rear region and a front region; wherein the feeder at its upper region has a first cartridge supporting surface and a second cartridge supporting surface, which are arranged in the third spatial direction at a distance from one another other, and which are designed respectively in such a way that a cartridge for a portable firearm can be moved from a storage position along it in the direction of the front region to a removal position, wherein the feeder moreover has a front guide part which forms at least one front support surface and a rear guide part which forms at least one rear support surface, wherein the rear support surface of the feeder is formed by at least a first support surface and a second support surface and that the first support surface is arranged on a rigid part and the second support surface on a movable part of the rear guide part.

Since the support surface of the rear region of the feeder of the cartridge magazine is formed by at least a first support surface and a second support surface and the first support surface is built on a rigid part and the second support surface on a movable part of the rear guide part, it is possible by way of the rigid part and the movable part of the rear guide part on the one hand (in at least one position) to ensure the function of the arrangement of a sufficiently large, and in particular to ensure a safe functioning sufficiently geometrically distributed, support surface, while each part in itself, in other words, both the rigid part, as well as the movable part of the rear guide part, (in at least one position) is suitable for fulfilling a further function. For example, the rigid part can additionally provide the function of a fixed abutment and/or a travel limiter and/or a guide and/or an insertion aid, while the movable part can additionally provide the function of a trigger, for example.

It is advantageous if the cartridge magazine includes a feeder that is further developed according to one of the claims 2 to 18.

The advantages resulting therefrom have already been described in connection with the feeder according to the invention and apply here analogously.

It is moreover advantageous if the cartridge magazine is further developed in such a way that for interaction with the first control surface of the movable part, an area of the inside surface of the rear wall extending at least substantially in the second spatial direction and third spatial direction is formed and, as a result, a superimposed movement of the movable part in the first spatial direction can be initiated when the feeder is moved in the third spatial direction.

A cartridge magazine designed in such a way makes it possible that the movable part of the rear area of the feeder in an empty magazine, i.e. in the state in which the main spring (and if a feeder unit is provided also a compression spring arranged between the outer feeder and the feeder) abuts with a partial area against the magazine lips or against a block provided on the housing side for limiting the travel of the feeder, the movable part passes to the rear over the edge of the magazine inner wall, provided that freedom of movement is provided in the first spatial direction between the first and second positions.

Surprisingly, this means that the breech mechanisms of self-loading rifles—especially of those designed for sporting use—whose functional edge of the follower provided on the side of the breech mechanism is offset upward by rounding compared with standard models of the same design, can also be safely captured.

It can be an advantage that the movable part of the feeder can attain its residual stress-free state in this position.

If the magazine is also designed according to the following design, the first position can then be reached particularly quickly.

It is also advantageous if an area of the inner surface of the rear wall extending at least substantially in the first spatial direction and the third spatial direction is formed for interaction with the second control surface of the movable part, and thereby a superimposed movement of the movable part in the second spatial direction can be initiated upon movement of the feeder in the third spatial direction.

It may be optional that this area corresponds to the side surface of a projection on the rear magazine wall directed into the interior of the magazine housing.

If this projection ends in the third spatial direction below the edge of the rear magazine wall, the movable part moves inside the magazine interior in the second spatial direction and reaches its second position.

It is optional that the support surface and/or a release surface of the movable part of the feeder arranged at an angle to it is then arranged on both sides of the center line of the feeder progressing in the first spatial direction.

In this way, for example, a slide catch lever can be released safely and reliably in many weapon models, for example in self-loading rifles according to the design examples of the AR-15/AR-16 type.

The present invention also provides a method for operating a portable firearm using a cartridge magazine, wherein, when operating the portable firearm, the cartridge magazine described above, and/or a cartridge magazine with a feeder described above, and/or a feeder unit described above is/are used.

The advantages resulting from this and in the use of advantageous embodiments of the present invention have already been described in connection with the feeder according to the invention for a cartridge magazine, the feeder unit and the cartridge magazine and apply here analogously.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1A:
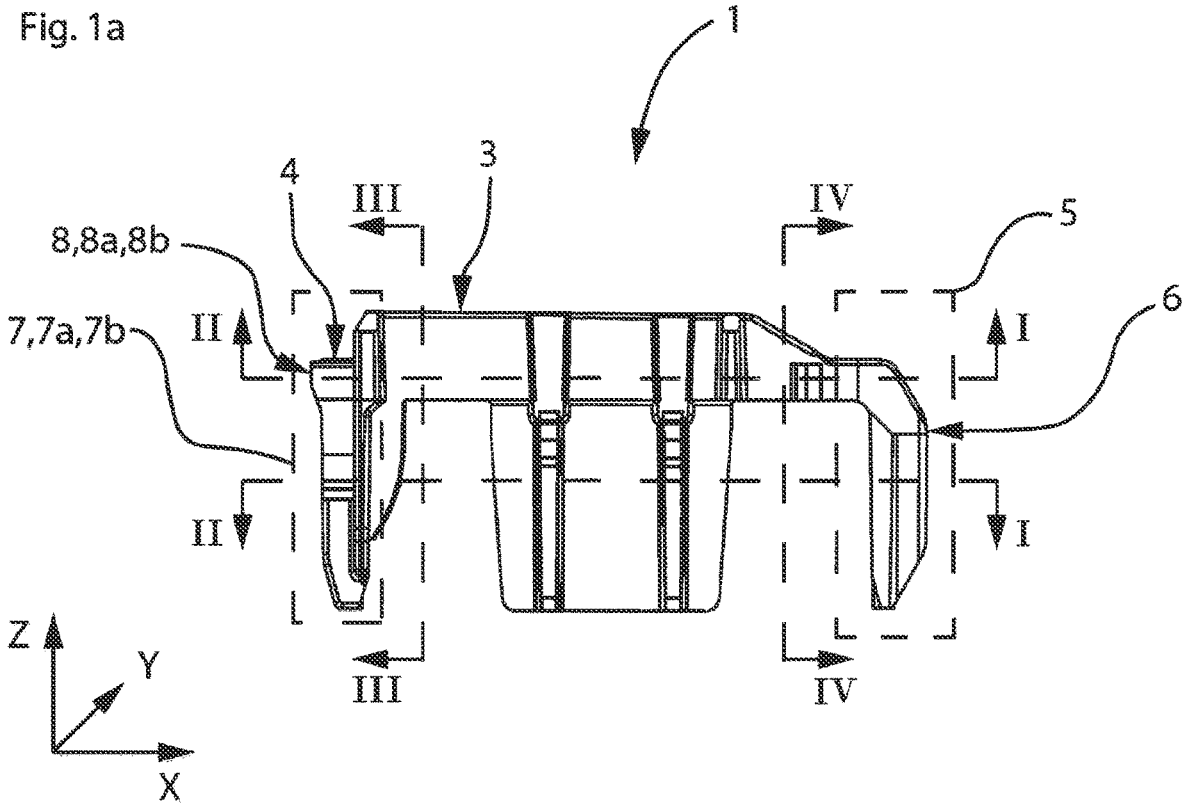
FIG. 1*a* is a feeder in a side view (right side)

The drawing with FIGS. 1*a* to 3*c* shows an optional design example of a feeder 1 according to the present invention for a cartridge magazine 2 for a portable firearm not shown; and in individual figures also a feeder unit 13 with a feeder 1 and a cartridge magazine 2 with a feeder 1 and/or a feeder unit 13. Same components are identified the same in all drawings, but do not have to be visible in all drawings. Accordingly, identically identified components or assembly groups are not repeatedly described in all drawings.

FIG. 1*a* shows feeder 1 for a cartridge magazine 2 for a portable firearm in the right side view, wherein the feeder extends from a first spatial direction X, a second spatial direction Y and a third spatial direction Z and thereby forming an upper region I, a lower region II, a rear region III and a front region IV. The spatial directions are represented in the figure in a coordinate cross and apply to all figures, even if the correspondingly adapted coordinate cross should not be represented in all figures.

Figure 1B:
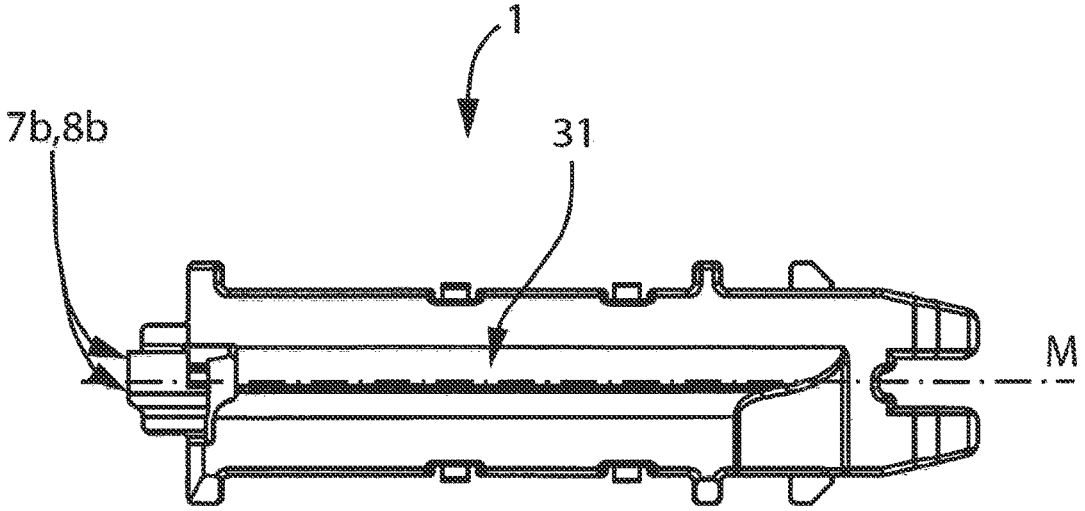
FIG. 1*b* is feeder in the top view.
Figure 3A:
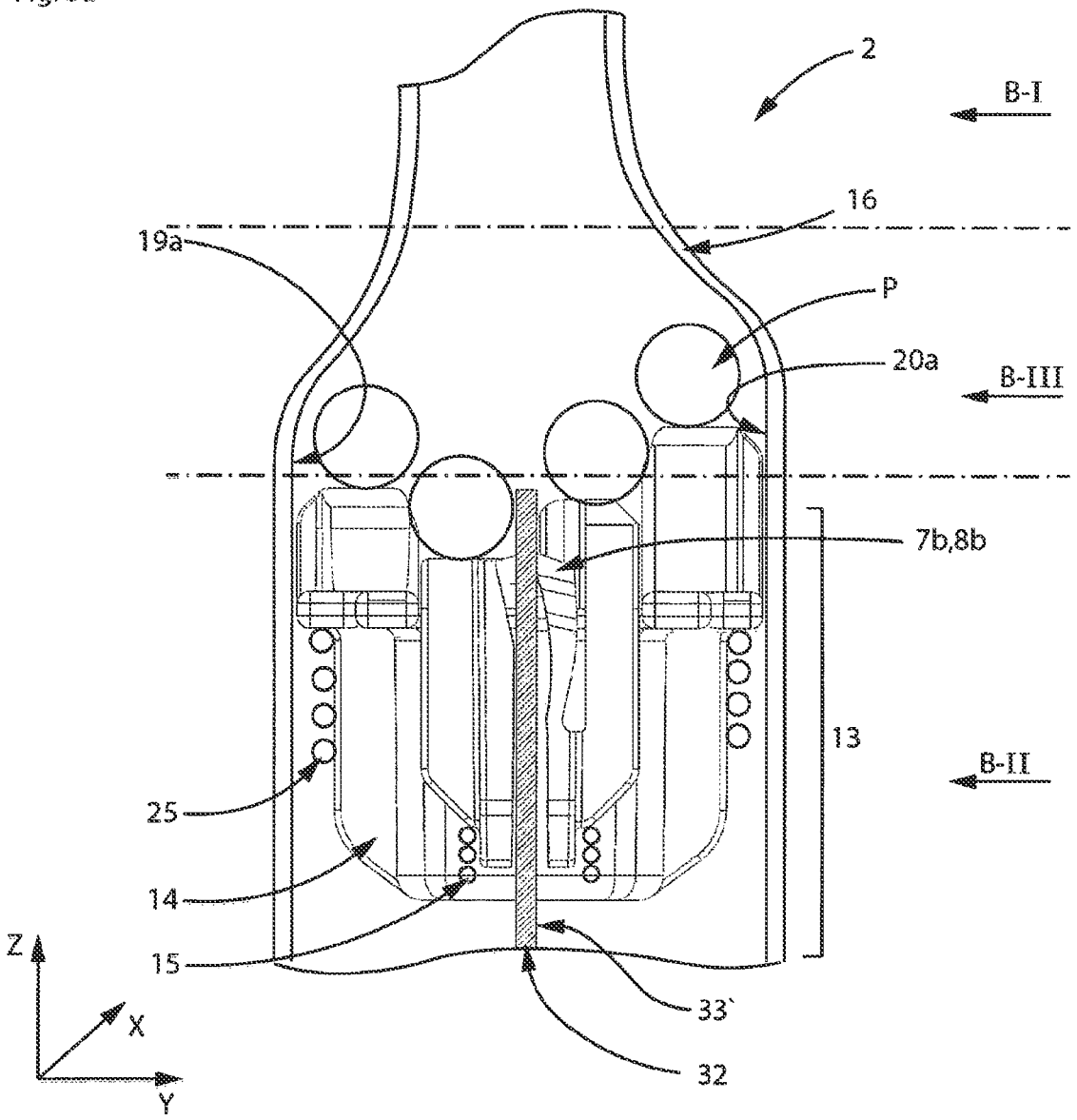
FIG. 3*a* is cartridge plug-in magazine with feeder unit and movable part of the feeder in third position in rear, partially cut view.
Figure 3B:
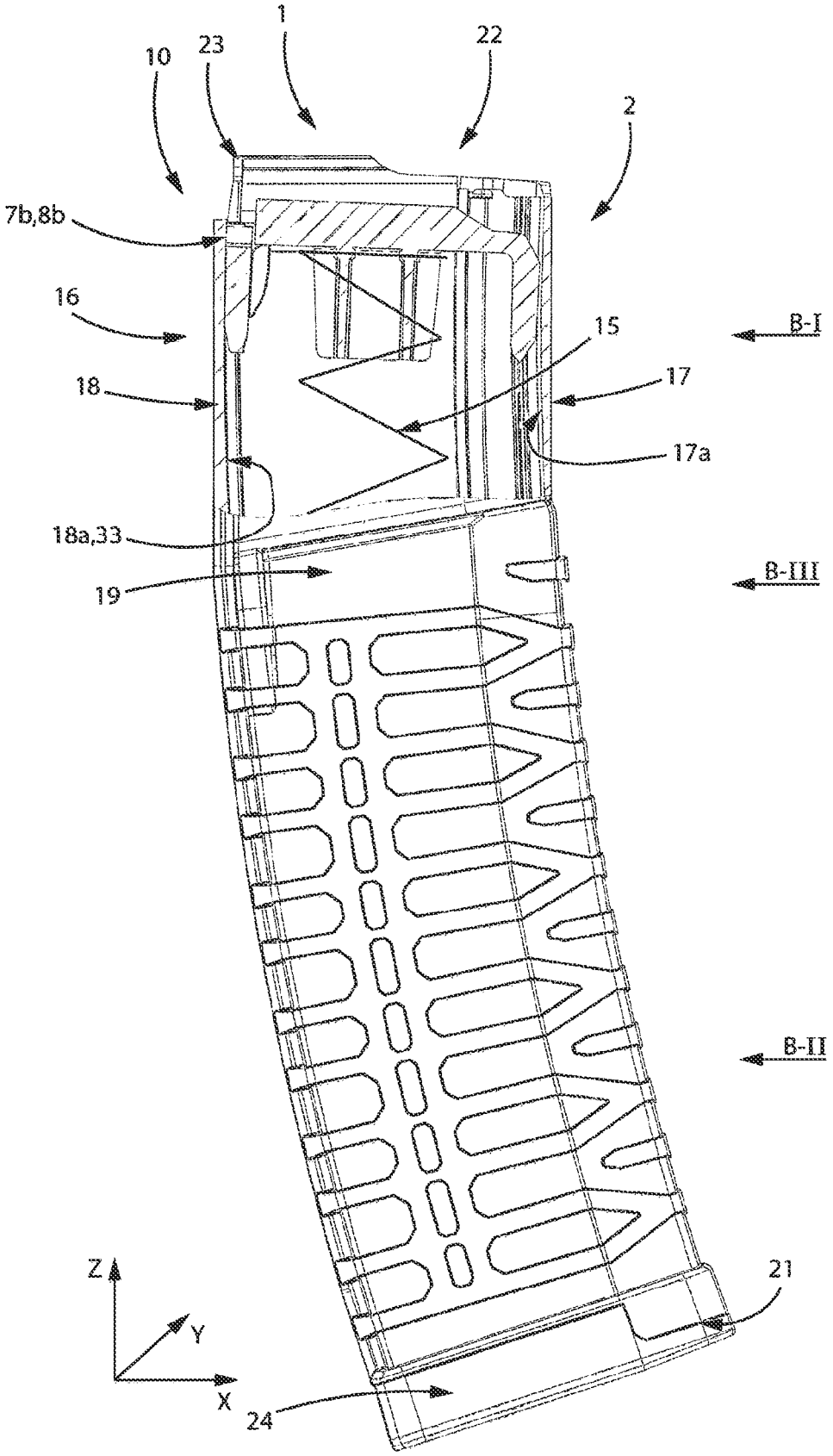
FIG. 3*b* is cartridge plug-in magazine with feeder unit and movable part of the feeder in second position in rear, partially cut view.
Figure 3C:
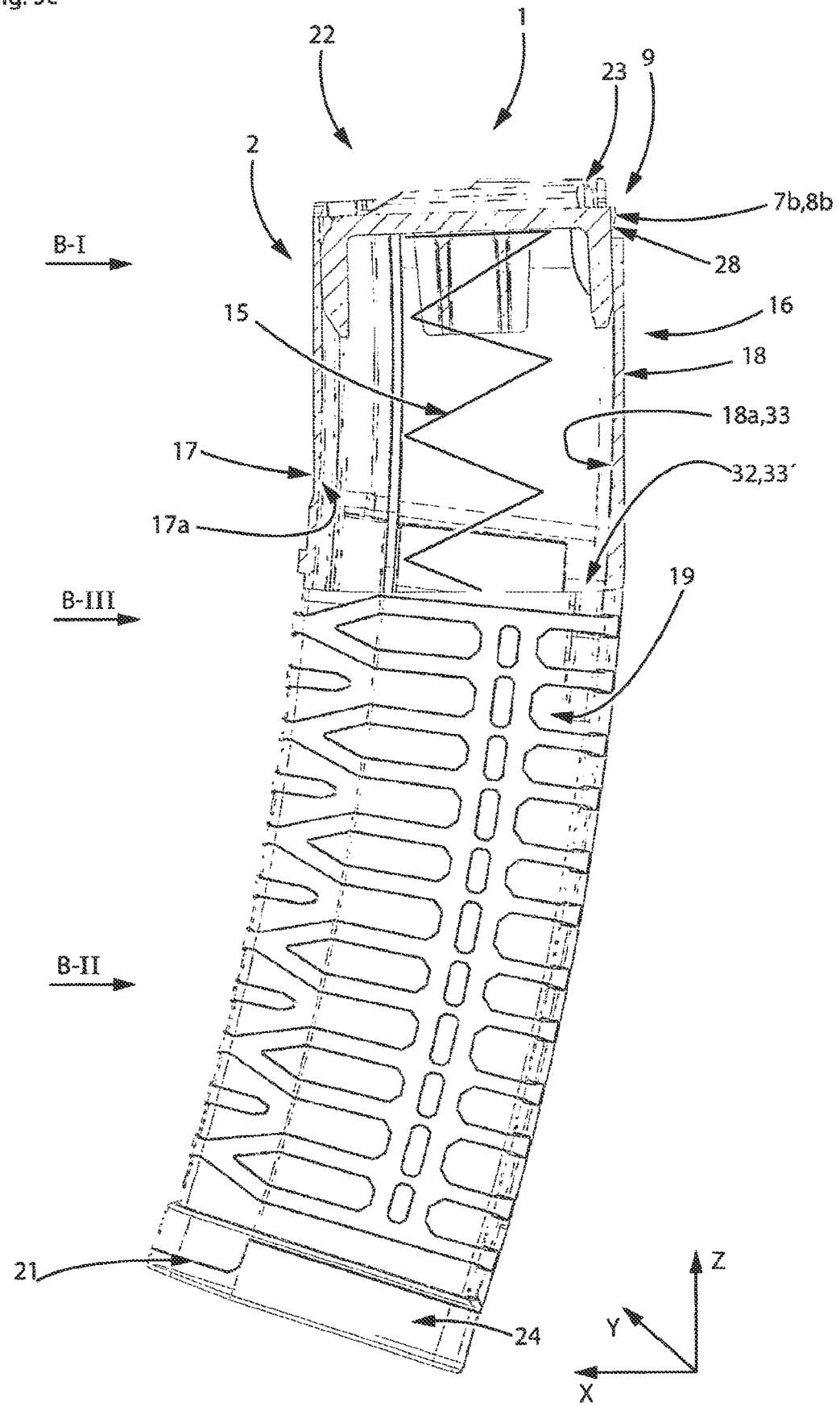
FIG. 3*c* is cartridge magazine in a side view, while the movable part of the feeder is in its first position.

Feeder 1 has at its upper area I a first cartridge supporting surface 3 and a second cartridge supporting surface 4, which are arranged in third spatial direction Z at a distance from each other, and which are each formed in such a way that a cartridge P shown in FIGS. 3*a* to 3*c* for a portable firearm is movable along it in the direction of front region IV. In order to simplify the further description of the optional embodiment shown in the figures, the lower cartridge supporting surface, visible for the first time in FIG. 1*b*, is to be designated as the first cartridge supporting surface 3 and the cartridge supporting surface already recognizable in this figure is designated as the second cartridge supporting surface 4. Of course, the designation would also be interchangeable without affecting the function.

Feeder 1 further includes a front guide part 5 forming at least one front support surface 6 and a rear guide part 7 forming at least one rear support surface 8, and wherein the rear support surface 8 is formed by at least one first support surface 8*a* and one second support surface 8*b*, and wherein first support surface 8*a* is formed on a rigid part 7*a* and the second support surface 8*b* is formed on a movable part 7*b* of the rear guide part 7.

Figure 1C:
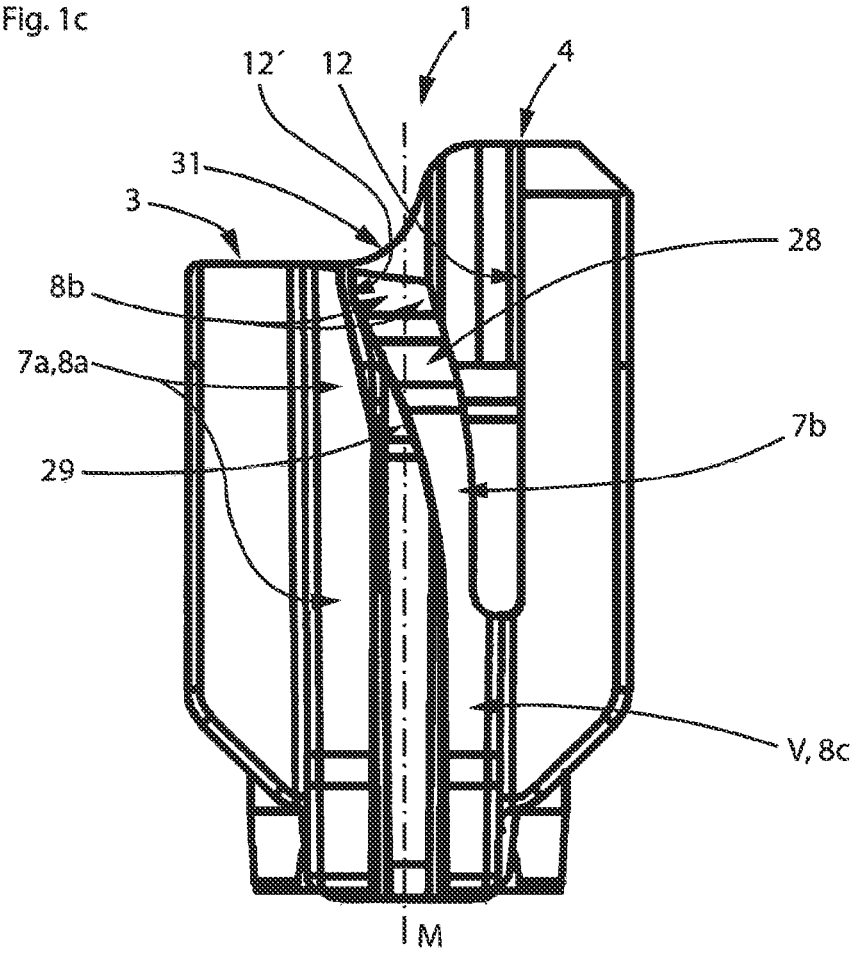
FIG. 1*c* is feeder in a rear view.
Figure 1D:
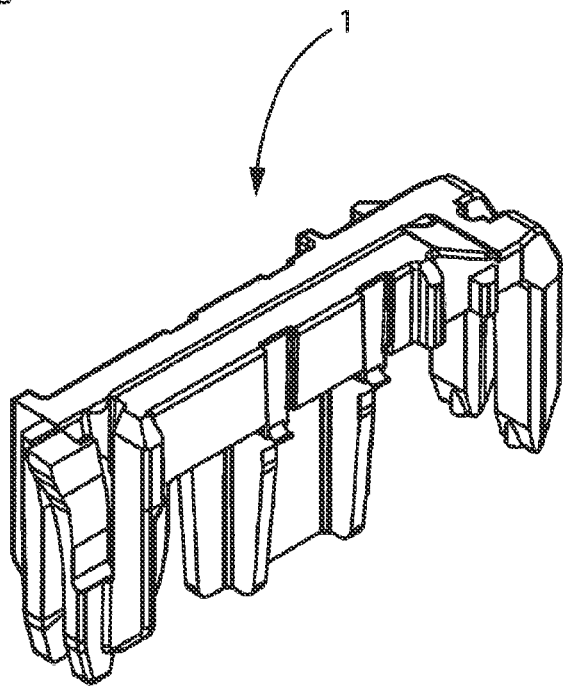
FIG. 1*d* is feeder in a perspective view.

In FIGS. 1*b*, 1*c* and 1*d* it can be seen that movable part 7*b* of rear guide part 7, which forms second support surface 8*b*, extends on both sides of the center line M of the feeder running in the first spatial direction. In at least one of the figures it is also recognizable that the second support surface 8*b* extends to both sides of the center line M.

The feeder shown is made of a plastic and has a one-piece design. Polyoxymethylene (POM) can be chosen as the plastic.

Movable part 7*b* forming second support surface 8*b* is designed as a movable leg which is articulated on one side to feeder 1, or to a connecting region V of the feeder, or—from this region—forms an extension of feeder 1 and whose longitudinal direction extends in third spatial direction Z, the free leg part extending above connecting region V in third spatial direction Z. In this case, the leg forms a "quasi-rigid" third support surface 8*c* at its point of articulation, i.e. in connecting region V.

Furthermore, movable part 7*b* representing second support surface 8*b* forms a first control surface 28, via which a movement from first position 9 to second position 10 can be initiated and a second control surface 29, via which a movement from second position 10 to second position 11 can be initiated.

In FIG. 1*b* the cartridge supporting surface is also clearly recognizable, which connects the two cartridge supporting surfaces 3 and 4, which are separated from each other in the third spatial direction.

Movable part 7*b* of rear guide part 7 of feeder 1, which forms second support surface 8*b*, is shown in FIGS. 1*a* to 1*d* in a first position 9, in which it is free of a reset force acting on it.

Figure 2A:
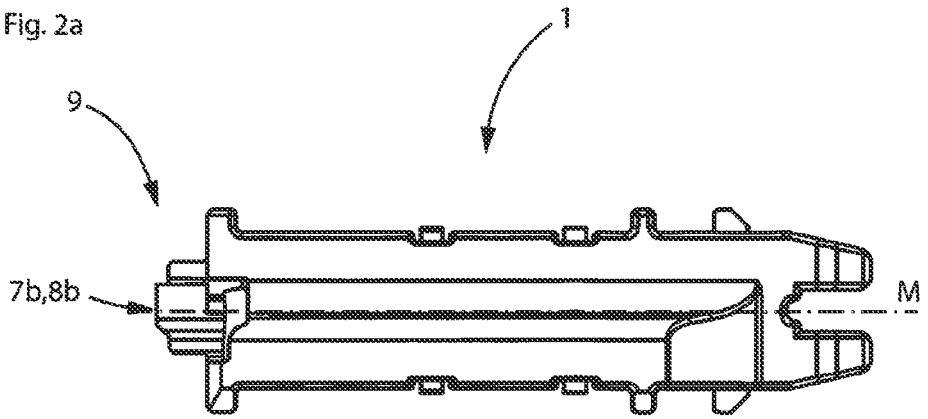
FIG. 2*a* is a detailed view with movable part in first position.
Figure 2B:
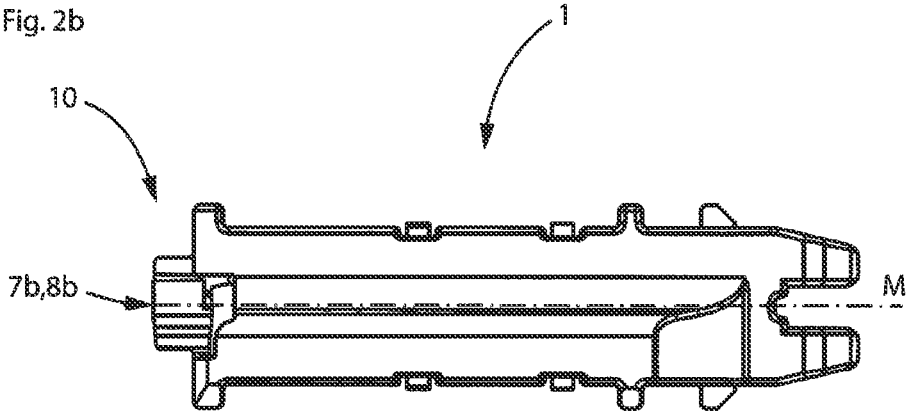
FIG. 2*b* is a detailed view with movable part in second position.
Figure 2C:
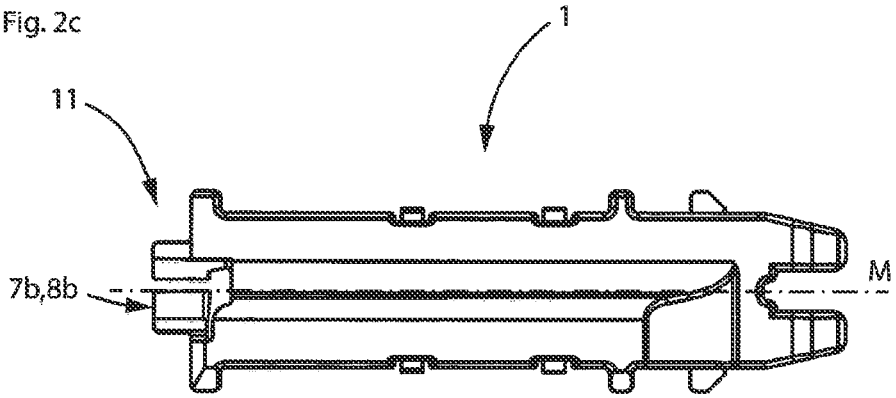
FIG. 2*c* is a detailed view with movable part in third position.

Movable part 7*b* of rear guide part 7 of the feeder 1 forming the second support surface 8*b* is shown again in this position 9 in a detailed view in FIG. 2*a*. From this position 9, movable part 7*b* can be moved against a first reset force F1—which is in a range between about 2.5 Newtons (N) and about 30 Newtons—in a first spatial direction into a second position 10, which it has assumed in FIG. 2*b*. Second position 10 is located in its motion sequence between first position 9 and third position 11 and can therefore be called an "intermediate position". In contrast to a second reset force F2, which is in a range between about 2.5 Newtons and about 30 Newtons and is greater than reset force F1, movable part 7*b* can be moved in the second spatial direction to a third position 11, in which it is located in the illustration according to FIG. 2*c*. Exceeding the desired movability in the second spatial direction is limited or even reduced to harmless small extent by a first travel limiter 12 and a second travel limiter 12'.

First support surface 8*a* and second support surface 8*b* are arranged in first position 9 at least in the first spatial direction X and in second position 10 in the second spatial direction Y at a distance from one another. In second position 10, however, the two support surfaces 8*a* and 8*b* are seen in the first spatial direction on the same level, i.e. are arranged in the first spatial direction without any technically relevant distance to each other.

In FIGS. 3*a* to 3*c* is a cartridge magazine 2 for a portable firearm, which is equipped with a feeder unit, wherein the feeder unit 13 with an outer feeder 14, an inner feeder and a compression spring 15, wherein the compression spring 15 is arranged between the outer feeder 14 and the inner feeder and the outer feeder 14 has a space, in which the inner feeder is movable against a spring force FD of the compression spring 15, and as an inner feeder has a feeder 1, as it is shown in FIGS. 1*a* to 2*c*.

In this regard, cartridge magazine 2 further includes a housing 16 for a cartridge magazine 2 for a portable firearm, extending along a first spatial direction X, a second spatial direction Y, and a third spatial direction Z, and forming in its interior an interior space IR having a first region B-I, a second region B-II, and an intermediate region B-III disposed therebetween. The first (upper, i.e. forming the magazine lips) region B-I has a two-row design and the second region B-II has a four-row design, with the transition from four-row stacking to two-row stacking then being provided in intermediate region B-III.

In this case, inner space IR is limited by inner surfaces 17*a*, 18*a*, 19*a*, 20*a* of a front wall 17, a rear wall 18, a first side wall 19 and a second side wall 20, wherein inner surfaces 17*a*, 18*a* of front wall 17 and of rear wall 18 are at a distance A (A) from one another in this at least one region B-I.

In this case, housing 16 has a housing bottom side 21 and a housing top side 22, wherein magazine lips 23 are formed on housing top side 22 and wherein housing bottom side 21 is designed to be at least partially open.

Cartridge magazine 2 shown further includes a bottom cover 24 which is suitable for at least substantially closing the at least partially open bottom side 21 of the housing.

For interaction with first control surface 28 of movable part 7*b* of feeder 1, an area of inner surface 18*a* of the rear wall 18 extending at least substantially in the second spatial direction Y and third spatial direction Z is formed in interior IR of housing 16 of cartridge magazine 2, whereby upon movement of feeder 1 in third spatial direction Z a superimposed movement of movable part 7*b* in first spatial direction X can be initiated.

For interaction with second control surface 29 of movable part 7*b* of feeder 1, an area of inner surface 18*a* of rear wall 18 extending at least substantially in the first spatial direction X and the third spatial direction Z is formed, which projects into the interior IR of housing 16 as a web-shaped protrusion. Through this area formed on a side wall—in this case on the right-hand side wall of the protrusion—a superimposed movement of movable part 7*b* in second spatial direction Y can be initiated during movement of feeder 1 in third spatial direction Z.

As a result, movable part 7*b* of the feeder can be moved and mechanically controlled in a defined manner between its first position, via its second position, to its third position.

FIG. 3*a* illustrates cartridge plug-in magazine 2 with feeder unit 13 and movable part 7*b* of feeder 1 in its position 11 in a partially cut rear view. The cartridge magazine is thereby at least partially filled, wherein a plurality of cartridges P are stored in interior IR of the cartridge magazine, forming a cartridge stack, which is guided under the influence of feeder 1

FIG. 3*b* shows cartridge plug-in magazine 2 in a partially cut rear view, wherein movable part 7*b* of feeder 1 of feeder unit 13 is in its second position 10.

In FIG. 3*c*, movable part 7*b* of feeder 1 assumes its first position 9. Cartridge magazine 2 is shown in a side view. Area 33' in this case is obviously on the non-visible back side of protrusion 32.

Component identification listing:

I Top region
II bottom region
III rear region
IV front region
A distance
B-I first region of interior housing space
B-II second region of interior housing space
B-III intermediate region of interior housing space
T
F1 first reset force
F2 second reset force
FD spring force
FH spring force
IR interior space
M center line P cartridge
V Connecting region (also hinged point)
X first spatial direction
Y second spatial direction
Z third spatial direction
1 feeder
2 cartridge magazine
3 first cartridge supporting surface
4 second cartridge supporting surface
5 front guide part
6 front support surface
7 rear guide part
7*a* rigid part
7*b* movable part
8 rear support surface
8*a* first support surface
8*b* second support surface
8*c* third support surface
9 first position
10 second position
11 third position
12 travel limiter
13 feeder unit
14 outer feeder
15 compression spring
16 housing
17 front wall
17*a* inside surface of front wall
18 rear wall
18*a* inside surface of rear wall
19 first side wall
19*a* inside surface of first side wall
20 second side wall
20*a* inside surface of second side wall
21 housing bottom side
22 housing top side
23 magazine lips
24 bottom cover
25 main spring
26 storage position
27 removal position
28 first control surface
29 second control surface
30 compression spring
31 cartridge support surface
32 protrusion
33 area
33' area While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A feeder for a cartridge magazine for a portable firearm, the feeder extending along a first spatial direction, a second spatial direction, and a third spatial direction, thereby forming an upper region, a lower region, a rear region, and a front region, the feeder comprising:

a first cartridge supporting surface at the upper region;

a second cartridge supporting surface, the first cartridge supporting surface and the second cartridge supporting surface being arranged in the third spatial direction spaced at a distance from one another in such a way that a cartridge for the portable firearm is movable along the feeder in a direction of the front region;

a front guide part including a front support surface;

a rear guide part including a rear support surface, a rigid part, and a movable part, the rear support surface including a first support surface and a second support surface, the first support surface being on the rigid part, the second support surface being on the movable part; and a plurality of lateral side regions which oppose one another, the first spatial direction extending between the front region and the rear region, the second spatial direction extending the plurality of lateral side regions, the third spatial direction extending between the top region and the bottom region, the movable part being configured for moving in the second spatial direction.

2. The feeder according to claim 1, wherein the movable part representing the second support surface is configured for being moved from a first position at least along the first spatial direction into a second position.

3. The feeder according to claim 2, wherein the movable part representing the second support surface is configured for being moved from the second position at least along the first spatial direction into a third position.

4. The feeder according to claim 3, wherein the movable part representing the second support surface is configured for being moved from the first position into the second position, against a first reset force.

5. The feeder according to claim 4, wherein the movable part representing the second support surface is configured for being moved from the second position into a third position, against a second reset force.

6. The feeder according to claim 5, wherein at least one of the first reset force and the second reset force is/are in a range of between approximately 2.5 N and approximately 30 N, between 4 N and 19 N, or between 4.5 N and 12.5 N.

7. The feeder according to claim 6, wherein the second reset force is greater than first reset force.

8. The feeder according to claim 3, wherein the movable part representing the second support surface comprises a first control surface configured for being that via which a movement from the first position into the second position is initiated.

9. The feeder according to claim 3, wherein the movable part representing the second support surface comprises a second control surface configured for being that via which a movement from the second position into the third position is initiated.

10. The feeder according to claim 3, wherein, in the first position, the movable part representing the second support surface is free of a reset force acting upon the movable part.

11. The feeder according to claim 3, wherein the first support surface and the second support surface are arranged in the first position in at least the first spatial direction and in the second position in the second spatial direction at a distance from one another.

12. The feeder according to claim 1, wherein the movable part representing the second support surface is configured for being moved from a first position at least along the second spatial direction into a second position.

13. The feeder according to claim 12, wherein the movable part representing the second support surface is configured for being moved from the second position at least along the second spatial direction into a third position.

14. The feeder according to claim 1, wherein the movable part representing the second support surface is configured for being moved from a first position at least along the third spatial direction into a second position.

15. The feeder according to claim 14, wherein the movable part representing the second support surface is configured for being moved from the second position at least along the third spatial direction into a third position.

16. The feeder according to claim 1, wherein the feeder includes at least one travel limiter configured for limiting a movability of the movable part of the rear guide part in at least one of the first spatial direction, the second spatial direction, and the third spatial direction.

17. The feeder according to claim 1, wherein the feeder is formed as a single-part component.

18. The feeder according to claim 1, wherein the feeder includes at least 95%, at least 98%, or at least 99.5% of plastic, which is polyoxymethylene, wherein, when operating the portable firearm, the feeder is configured for being used.

19. A feeder unit, comprising:

an outer feeder;

an inner feeder; and a compression spring, the compression spring being arranged between the outer feeder and the inner feeder, the outer feeder having a space into which the inner feeder is movable against a spring force of the compression spring, the inner feeder formed as a feeder for a cartridge magazine for a portable firearm, the feeder extending along a first spatial direction, a second spatial direction, and a third spatial direction, thereby forming an upper region, a lower region, a rear region, and a front region, the feeder including:

a first cartridge supporting surface at the upper region;

a second cartridge supporting surface, the first cartridge supporting surface and the second cartridge supporting surface being arranged in the third spatial direction spaced at a distance from one another in such a way that a cartridge for the portable firearm is movable along the feeder in a direction of the front region;

a front guide part including a front support surface; and a rear guide part including a rear support surface, a rigid part, and a movable part, the rear support surface including a first support surface and a second support surface, the first support surface being on the rigid part, the second support surface being on the movable part.

20. The feeder unit according to claim 19, wherein, when operating the portable firearm, the feeder unit is configured for being used.

21. A cartridge magazine for a portable firearm, the cartridge magazine comprising:

a housing, the housing extending along a first spatial direction, a second spatial direction, and a third spatial direction and including an interior space with at least one first region, the housing including a front wall, a rear wall, a first side wall, a second side wall, a bottom side, and a top side, the front wall, the rear wall, the first side wall, and the second side wall together including a plurality of inside surfaces, the interior space being limited by the plurality of inside surfaces, respective ones of the plurality of inside surfaces of the front wall and the rear wall in the at least one first region being located at a distance A from one another, the bottom side being configured for being at least partially open;

a plurality of magazine lips formed on the top side of the housing;

a bottom cover, which is configured for at least substantially closing the bottom side;

a main spring;

at least one first feeder, which is arranged in the interior space of the cartridge magazine against a spring force of the main spring in a direction of the bottom side of the housing, and the at least one feeder extending along the first spatial direction, the second spatial direction, and the third spatial direction, thereby forming an upper region, a lower region, a rear region, and a front region, the at least one feeder comprising:

a first cartridge supporting surface at the upper region;

a second cartridge supporting surface, the first cartridge supporting surface and the second cartridge supporting surface being arranged in the third spatial direction at a distance from one another and configured respectively in such a way that a cartridge for the portable firearm is configured for being be moved from a storage position along the at least one feeder in a direction of the front region to a removal position;

a front guide part including at least one front support surface;

a rear guide part including at least one rear support surface, a rigid part, and a movable part, the at least one rear support surface including a first support surface and a second support surface, the first support surface being on the rigid part, the second support surface being on the movable part; and a plurality of lateral side regions which oppose one another, the first spatial direction extending between the front region and the rear region, the second spatial direction extending the plurality of lateral side regions, the third spatial direction extending between the top region and the bottom region, the movable part being configured for moving in the second spatial direction.

22. The cartridge magazine according to claim 21, wherein the movable part representing the second support surface is configured for being moved from a first position at least along the first spatial direction into a second position, the at least one feeder being arranged movably in a direction of the bottom cover.

23. The cartridge magazine according to claim 21, wherein the movable part includes a first control surface, the respective one of the plurality of inside surfaces of the rear wall including an area extending at least substantially in the second spatial direction and the third spatial direction, the area being configured for interacting with the first control surface, wherein, as a result, the movable part is configured such that a superimposed movement of the movable part in the first spatial direction can be initiated when the at least one feeder is moved in the third spatial direction.

24. The cartridge magazine according to claim 21, wherein the movable part includes a second control surface, the respective one of the plurality of inside surfaces of the rear wall including an area extending at least substantially in the first spatial direction and the third spatial direction, the area being configured for interacting with the second control surface, wherein, as a result, the movable part is configured such that a superimposed movement of the movable part in the second spatial direction can be initiated when the at least one feeder is moved in the third spatial direction.

25. The cartridge magazine according to claim 21, wherein, when operating the portable firearm, the cartridge magazine is configured for being used.

* * * * *